US006921322B2

(12) United States Patent
Takata et al.

(10) Patent No.: US 6,921,322 B2
(45) Date of Patent: Jul. 26, 2005

(54) APPARATUS AND METHODS FOR REFINISHING A SURFACE IN-SITU

(75) Inventors: Victor Takata, deceased, late of Waltham, MA (US); by Andrew E. Donovan, legal representative, Waltham, MA (US); Edmund L. Pessa, Arlington, MA (US); David A. Hudson, Stoughton, MA (US)

(73) Assignee: Artisan Industries, Inc., Waltham, MA (US)

( * ) Notice: Subject to any disclaimer, the term of this patent is extended or adjusted under 35 U.S.C. 154(b) by 94 days.

(21) Appl. No.: 10/350,625

(22) Filed: Jan. 24, 2003

(65) Prior Publication Data

US 2004/0147208 A1 Jul. 29, 2004

(51) Int. Cl.[7] ..... B24B 15/03

(52) U.S. Cl. ..... 451/252; 451/115; 451/430; 451/443; 451/49; 451/51; 451/63

(58) Field of Search ..... 451/252, 430, 451/115, 443, 49, 51, 63, 56; 125/11.01

(56) References Cited

U.S. PATENT DOCUMENTS

| | | | | | |
|---|---|---|---|---|---|
| 1,924,958 | A | * | 8/1933 | Patterson | 451/430 |
| 2,351,269 | A | * | 6/1944 | Kropf et al. | 125/11.06 |
| 2,809,483 | A | * | 10/1957 | Alexander | 451/430 |
| 2,985,589 | A | | 5/1961 | Broughton et al. | |
| 3,040,777 | A | | 6/1962 | Carson et al. | |
| 3,221,727 | A | * | 12/1965 | Pitcl et al. | 125/11.01 |
| 3,422,848 | A | | 1/1969 | Liebman et al. | |
| 3,889,424 | A | | 6/1975 | Buhayar et al. | |
| 4,411,105 | A | | 10/1983 | Raiha | |
| 4,465,091 | A | * | 8/1984 | Keller | 137/243.6 |
| 4,545,706 | A | * | 10/1985 | Hiroyasu et al. | 408/1 BD |
| 4,566,229 | A | * | 1/1986 | Lillie et al. | 451/430 |
| 4,599,769 | A | | 7/1986 | Latzko et al. | |
| 4,715,149 | A | * | 12/1987 | Kelsey | 451/430 |
| 4,800,684 | A | * | 1/1989 | Effenberger | 451/28 |
| 4,825,596 | A | | 5/1989 | Kinner | |
| 4,930,261 | A | | 6/1990 | Tiegs et al. | |
| 4,958,464 | A | * | 9/1990 | Menendez | 451/430 |
| 5,030,046 | A | | 7/1991 | Ricci | |
| 5,148,633 | A | | 9/1992 | Pigott et al. | |
| 5,230,183 | A | | 7/1993 | Wagner, Jr. | |
| 5,231,800 | A | | 8/1993 | Widdell | |
| 5,302,051 | A | | 4/1994 | Wilson, Sr. | |
| 5,595,528 | A | * | 1/1997 | Becker | 451/72 |
| 5,897,429 | A | * | 4/1999 | Durovchic | 451/430 |
| 6,042,456 | A | | 3/2000 | Foster | |
| 6,319,104 | B1 | | 11/2001 | Emter | |
| 6,461,228 | B2 | * | 10/2002 | Stocker et al. | 451/44 |

FOREIGN PATENT DOCUMENTS

| | | | | |
|---|---|---|---|---|
| DE | 38141189 | * | 11/1989 | 451/433 |

OTHER PUBLICATIONS

Deublin® Rotating Unions, "Deublin® Rotating Unions Precision Rotating Connections for Water, Steam, Air, Hydraulic, Vacuum, Coolant and Hot Oil Service," Engineering Catalog 952A, 1997, pp. 1–5, 56, 63 and 64, USA.

* cited by examiner

*Primary Examiner*—George Nguyen
(74) *Attorney, Agent, or Firm*—Leslie Meyer-Leon, Esq.; IP Legal Strategies Group P.C.

(57) ABSTRACT

The invention features a self-contained, portable apparatus for performing precision grinding operations on metal disks of up to, e.g., 54 inches in diameter. The apparatus can be attached to the surface of the disk to be refinished and is leveled using special precision leveling adjusters. During operation, the adjusters are turned in precision increments to set the depth of cut. The grinder is then rotated on an arm about the center of the disk, by the use of a hydraulically driven speed reducer, rotor, bearing assembly. In a further aspect, the invention includes a dressing assembly for performing dressing-truing on a vitreous wheel when the wheel is in grinding position. The in position dressing assembly dresses a grinding wheel at up to 0.00125-inch increments.

20 Claims, 9 Drawing Sheets

APPARATUS AND METHODS FOR REFINISHING A SURFACE IN-SITU

FIELD OF THE INVENTION

This invention relates to a device for and method of refinishing a surface in situ. Such a surface can include the surface of a work piece in a valve such as a rotary valve.

BACKGROUND OF THE INVENTION

A rotary valve is a valve that rotates intermittently to control fluid flow. A rotary valve typically includes a track plate, a rotor plate, and an upper pressure-tight shell or casing. The casing and the trackplate form a fluid-tight housing totally enclosing the rotor plate. The rotor plate is maintained in fluid-tight contact with the track plate, and rotates in a horizontal plane. It has a slick, smooth surface, referred to as a "seal surface", and a number of channels and holes and/or ports that communicate with corresponding channels, holes and/or ports in the trackplate, in order to direct the flow of fluid within the valve.

Wear and tear to the surface of the trackplate during use can cause it to be damaged to such an extent that the necessary sealing required for proper fluid control is impaired. Such damage can be caused by corrosion, erosion, friction, or distortion, or by the presence of foreign objects. Once the surface is damaged, either repair or replacement is necessary to reestablish an acceptable seal, so that the function of the rotary valve for the particular fluid control application is not affected. To avoid the significant cost of replacing a worn workpiece, the surface of the workpiece is refinished, by a process commonly referred to as 'resurfacing.'

Although portable-lapping machines can be used to repair and refinish a workpiece surface in the field, they are suitable only for minor repairs. When the workpiece has been heavily damaged, or when precision resurfacing is necessary, lapping is impractical due to its limited capabilities for precision refinishing, excessive time, and wear to the parts. This is because the lapping machine's grinding and resurfacing apparatus produces an irregular surface finish, causing an ineffective seal within the rotary valve.

When use of a lapping machine is unsuitable, the trackplate must be removed and outsourced for resurfacing. This involves removing the trackplate, and shipping it to the site of a specially designed resurfacing machine. Trackplates used in large rotary valves are difficult to remove due to the size of the valve itself, and shipment is expensive and slow. Thus, in the case of rotary valves that are very large, such as those used in petrochemical refineries, this process is extremely costly and time consuming, thereby causing the refinery lost production time. It is therefore desirable to develop a resurfacing apparatus that can be used for precision resurfacing of heavily damaged workpieces "in situ," that is, while remaining on-site at the location where the rotary valve is installed, and preferably, to further develop a process for resurfacing the surface of the trackplate without removing it from the rotary valve.

SUMMARY OF THE INVENTION

The present invention is directed to an apparatus, device, and methods for precision refinishing a surface in situ. Preferably, the present invention is directed to a device designed to refinish a workpiece of a rotary valve in situ. This offers the significant advantage of repairing damaged precision equipment in the field to avoid the time delays and costs associated with sending the equipment back to the manufacturer for repair. Preferably, the surface is refinished so that it is flat to no greater than a total variance of 0.002 inch, and less for smaller diameters. The diameters range from less than 18 inches to nearly 6 feet, with a finish of sixteen (16) micro-inch or better.

In one aspect, the present invention is directed to a machine apparatus for refinishing a workpiece surface in situ. The device includes an upper framework, a grinding assembly, a lower framework, an adjuster assembly system, and a power source attachment assembly. In one embodiment of the present invention, the upper framework includes a housing, a rotation assembly, a spindle assembly connected to the rotation assembly, a connection system for attaching the housing to the spindle assembly, and a drive mounting plate. The drive mounting plate connects the spindle assembly and the rotation assembly to the grinding assembly. The housing can be of any shape that is suitable for mounting on the particular workpiece to be resurfaced. In one preferred embodiment, the housing has at least three outward surfaces and a passage that extends axially through the housing. Preferably, the housing is 'rigid,' meaning that it is of a material that is capable of limiting vibration and motion. The rotation assembly can include a drive motor, a drive shaft, a hollow shaft reducer coupled to the drive shaft, and a rotary union. Preferably, the drive shaft extends axially through the passage of the rigid housing.

The rotary union (a.k.a., 'rotating union' or rotary/rotating 'joint') allows a working fluid, e.g., an hydraulic fluid, to be introduced into the hydraulic system of the grinding assembly, while the grinding assembly is rotating without fouling or twisting hydraulic hoses. Where the refinishing apparatus is powered by pneumatic or airpowered equipment, the rotary union acts similarly to prevent air hoses from becoming fouled or twisted. The spindle assembly can include a spindle, a spindle frame attached to the spindle, a plurality of spindle bearings that are disposed between the spindle and the spindle frame, a spacer that is disposed between the spindle and the spindle frame, and a top and bottom spindle cover, both of which are independently and securely attached to the spindle and the spindle frame. The connection system can include a plurality of mounting brackets.

In yet another embodiment, the grinding assembly includes a feed assembly and a grinding wheel assembly coupled to the feed assembly. The feed assembly can include a feed slide and a feed arm coupled to the feed slide. In another preferred embodiment, the grinding wheel assembly includes a wheel drive motor assembly, a grinder spindle connected to the wheel drive motor assembly, and a grinding wheel rotably coupled to the grinder spindle. More preferably, the grinding wheel assembly further comprises a wheel guard mounted on the grinder spindle housing. Optionally, the grinding wheel assembly can further comprise a single point surface-removing tool mounted to the wheel guard for machining gouges or deep grooves from the workpiece surface prior to grinding. In such an embodiment, the wheel guard is adapted for receiving the single point tool.

In still another embodiment, the lower framework includes a base ring and an adapter ring, or adapter plate. Preferably, the base ring is 'rigid,' meaning that it is of a material that is capable of limiting vibration and motion. In a preferred embodiment, the adapter ring is removably attached to the base ring and the surface to be refinished. The adapter ring attaches to the workpiece and can be easily modified or customized for different sizes and types of workpieces, as would be known to those skilled in the art.

The invention further includes a plurality of adjuster assemblies for adjusting the vertical height and balance of the upper framework over the lower framework. The adjuster assembly permits very precise vertical motion, e.g., to increments of ten thousandths of an inch. Preferably, the refinishing apparatus includes at least three or more adjuster assemblies; three adjuster assemblies is optimal for ease of leveling, but greater numbers of adjuster assemblies can be used where increased stability or shock absorption is desired.

The adjuster assembly system preferably includes an upper assembly (top sub-assembly, a lower assembly (bottom sub-assembly), and an adjuster screw that connects the upper assembly to the lower assembly. The upper assembly adjuster is connected to the upper framework, and the lower assembly is connected to the lower framework. The upper assembly preferably includes a lock collar attached to the adjuster screw, a screw bushing assembly attached to the lock collar, a thrust bearing assembly attached to the screw bushing assembly, and a thrust collar attached to the thrust bearing assembly. Another alternative embodiment is for the lower assembly to include a torque collar attached to the adjuster screw, at least one base adjuster screw attached to the torque collar, at least one spherical bushing attached to the base adjuster screw, at least one retainer ring attached to the spherical bushing, at least one spherical bearing adapter disposed between the torque collar and the spherical bushing, and at least one retaining ring attached to the spherical bushing adapter.

In another aspect, the invention features a dresser assembly for in-position restoration of a grinding wheel. The dresser assembly includes a dresser slide housing, a dresser slide movably disposed within the dresser slide housing, a dresser tool attached to the dresser slide, and means for placing the dresser slide housing in functional proximity to a grinder wheel.

The invention further features a method of refinishing a trackplate surface by attaching any one of the refinishing apparati described above to a workpiece, and allowing the grinding assembly to rotate while refinishing the workpiece. Preferably, the grinding assembly moves across, e.g., by rotating over, e.g., rotating around the circumference of, the trackplate. More preferably, the trackplate is in a stationary position. Optionally, the method of refinishing can further include dressing the grinding wheel with a dressing assembly that is in functional proximity to dress the grinding wheel while it is in position in the grinding assembly.

BRIEF DESCRIPTION OF THE DRAWINGS

A preferred embodiment of the present invention is shown in the accompanying drawings which, together with the description thereof, will serve to exemplify the invention. The particular structure illustrated can be modified by those skilled in the art without departing from the broad scope of the invention.

DETAILED DESCRIPTION OF THE INVENTION

Figure 1:
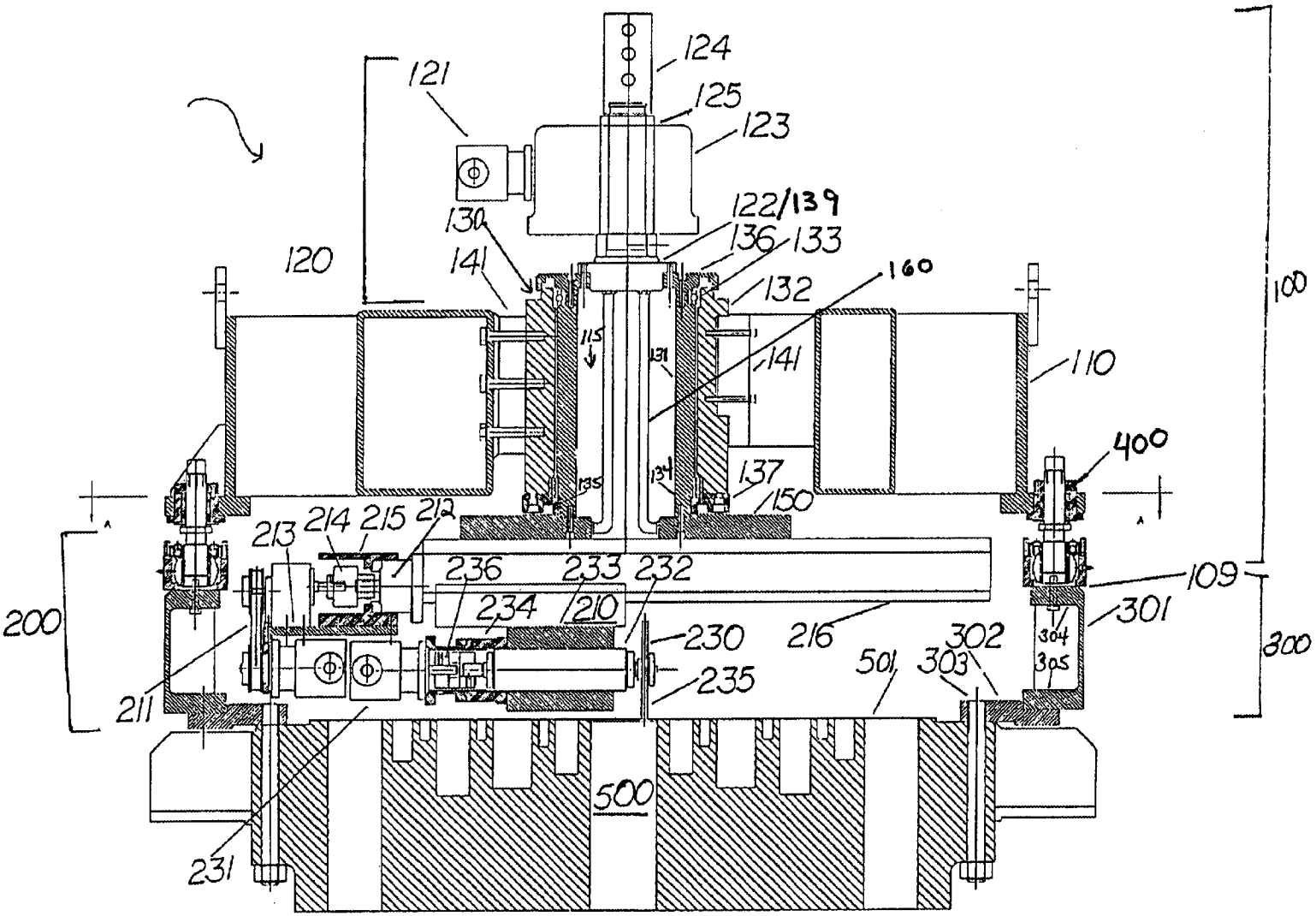
FIG. 1 is a general section view of an assembled refinishing apparatus of the invention.

This invention is specially designed to machine and grind precision surfaces on, equipment used in, e.g., the chemical process industry, without removing the equipment from its on-site location, i.e., while the workpiece remains in the field, or 'in situ.' By repairing damaged or worn precision equipment in the field, the great time delays and high cost of sending the equipment back to the manufacturer for resurfacing are avoided.

In most turning and grinding applications used in the manufacture of large chemical process equipment, the material that is being machined, the workpiece, is rotated, while the machine tool is held in a stationary position. The present invention is able to depart from this practice because the workpiece can be machined in situ. In particular, where the workpiece is the trackplate of a rotary valve, the workpiece can be resurfaced while remaining at the plant, e.g., refinery plant, where it is normally used. Even more preferably, the workpiece can optionally be resurfaced while left in its native position on the equipment of which it is a normal part, e.g., on the stator plate of the rotary valve. In this case, the machine tool (here, a precision-grinding spindle) is rotated, and the workpiece is kept in a fixed position. This is accomplished by mounting a precision-grinding spindle rigidly to a stiff frame so that the spindle can be fed radially in or out while simultaneously being spun at predetermined speeds about the center of the workpiece.

The preferred embodiment described below, and illustrated in the accompanying drawings, features a self-contained, portable hydraulically powered apparatus for performing precision grinding operations on metal disks of up to, e.g., 54 inches in diameter, for example and without limitation, 18, 24, 34, 40, 48, 54, 60, or 65 inches in diameter. The apparatus is bolted to the surface of the disk to be refinished using studs and nuts, and is leveled using special precision leveling equipment, referred to below as 'adjuster assemblies.' During operation, the adjuster screws within the adjuster assemblies are turned in precision increments to set the depth of cut. The grinder is then rotated on an arm about the center of the disk, by the use of a hydraulically driven speed reducer, rotor, bearing assembly. A hydraulic motor powers the grinder. The speed of the wheel and arm, and the speed of the feed, are adjustable, and are set using flow control valves. The grinder can be fed radially back and forth across the disk using a precision slide that operates at optimal feed rates through the use of a belt driven speed reducer and a torque-limiting coupling. Optionally, the invention further includes a wheel guard to which is mounted a precision threaded single point diamond nib for dressing the grinding wheel. The wheel can be dressed at 0.00125-inch increments. Increments can be identified with dots adjacent the threaded nib. The screwdriver slot in the nib is used with the dots to determine the amount of the wheel to be dressed. In another option, a single point tool can be mounted to the wheel guard. This embodiment of the invention is described in further detail by FIGS. 1–9.

FIG. 1 is a general section view of an assembled refinishing apparatus of the invention. The refinishing device 1 includes an upper framework 100, a grinding assembly 200, a lower framework 300, and adjuster assemblies 400. Preferably, the apparatus further includes components for detachably connecting to a power source. The lower framework 300 is attached either to the workpiece 500 or to the housing of the rotary valve in which workpiece 500 is located, for the purpose of refinishing the workpiece surface 501.

Referring to FIG. 1, the upper framework 100 includes rigid housing 110, rotation drive assembly 120, spindle assembly 130, mounting brackets 141 for connecting the rigid housing 110 to the spindle assembly 130, and drive mounting plate 150.

The rigid housing 110 can be any suitable housing, but is preferably a material that is of a stiffening construction and of a mass to weight ratio that is capable of absorbing vibrations or other movements during operation to prevent vibrations from causing imperfections in the workpiece surface 501.

The rigid housing 110 supports the spindle assembly 130 and is attached directly to the spindle frame 132 by mounting brackets 141. Rigid housing 110 includes outward surfaces 110*a*, 110*b*, and 110*c*, and a passage 115 that extends axially through the rigid housing 110. Hoses 160 extend through passage 115 for the flow of, e.g., hydraulic fluid or pneumatic air pressure.

The spindle assembly 130 is fastened to the drive mounting plate 150 through the spindle 131 and rotates with the drive mounting plate 150 through the rotation assembly 120. Spindle assembly 130 includes a spindle 131, a spindle frame 132, main spindle bearings 133, precision spindle bearings 134, spacers 135, a top spindle cover 136, and one or more bottom spindle covers 137. The spindle frame 132 is supported by the rigid housing 110 and by precision spindle bearings 134. The precision spindle bearings 134 rest on a spacer 135 and on the bottom spindle cover 137. The precision spindle bearings 134 are disposed between the spindle frame 132 and the spindle 131, while the spacer 135 is disposed between the bottom spindle cover 137 and the spindle 131. The top spindle cover 136 is secured to the spindle 131, and is supported by a main spindle bearing 133 and by the spindle frame 132.

Rotation of slide arm assembly 216 is accomplished by rotation assembly 120. The rotation assembly 120 includes a drive motor 121, a drive shaft. 122, a hollow shaft speed reducer 123 and a rotary union 124. The rotary union 124 is coupled to the hollow shaft speed reducer 123, which is coupled to the drive shaft 122 through a hollow shaft with key 125, or by other appropriate means. The rotary union allows a working fluid, e.g., hydraulic fluid, to be introduced into the hydraulic system of the grinding assembly, while the grinding assembly is rotating without fouling or twisting hydraulic hoses. Where the refinishing apparatus is powered by pneumatic or air-powered equipment, the rotary union acts similar to prevent air hoses from becoming fouled or twisted. Rotary unions suitable for use in the refinishing apparatus of the invention include, without limitation, Deublino® Rotating Unions, Deublin Company, Waukegan, Ill. Flow control valves can be located, e.g., intermediate between the rotary union and the hydraulic unit (not show), as would be known to one skilled in the art.

The drive mounting plate 150 and the spindle 131 are rotated together by the hollow shaft speed reducer 123. Preferably, the drive mounting plate 150 and the spindle 131 are rotated about a central axis of the workpiece 500.

As further illustrated in FIG. 1, the grinding assembly 200 includes a feed slide. 210 and a grinding wheel assembly 230. The feed slide 210 includes a feed drive motor 211, feed slide adapter 212, feed drive motor base 213, overload coupling feed 214, and adapter brackets for the feed drive adapter 215. The feed drive motor 211 is coupled to the feed drive motor base 213. The base 213 is coupled to the overload coupling feed 214, which is coupled to a slide arm assembly 216. Feed slide adapter 212 is secured to slide arm assembly 216 and encloses overload coupling feed 214. The top side of the slide arm assembly 216 is attached to the drive mounting plate 150, and the grinder spindle housing 233 on its bottom side. The feed drive motor 211 is preferably a belt driven motor, but can be any suitable driving means. The feed slide 210 is mounted to one side of the slide arm assembly 216 and is fed by an internal feed screw (not shown) by means of various couplings and gearings well known in the art. The purpose of the feed screw is to advance and retract the grinding wheel assembly 230.

The grinding wheel assembly 230 includes a wheel drive motor 231, a grinder spindle 232, a grinder spindle housing 233, grinder spindle adapter brackets 234, and a grinding wheel 235. Coupler 236 is between grinder spindle 232 and the hydraulic motor. The wheel drive motor 231 is a direct drive motor, but as is well known in the art, can be any suitable motor, and is mounted on one end of the grinder spindle 232. The grinder spindle 232 in enclosed by the grinder spindle housing 233. The grinder spindle housing 233 is also coupled to the slide arm assembly 216.

Optionally, a single point tool (not shown) can be mounted on the wheel guard 611 for machining any deep grooves, indentations, or chips from workpiece surface 501. Machining with a single point tool is optionally performed to prepare the workpiece surface 501 for subsequent grinding by-the grinding wheel 235.

The lower framework 300 includes base ring 301 and an adapter ring 302. The adapter ring 302 is securely attached to the workpiece 500. Preferably, the adapter ring 302 is attached through a number of removable screws and studs 303. The adapter ring supports the rigid base ring 301. The base ring 102 provides circumferential bottom support for the equipment. A base ring 301 includes an upper flange 304, to which the adjuster assemblies 400 mount to, and a lower flange 305, to which the adapter ring 302 is attached. The base ring 301 must be rigid so that it can also absorb any vibration Adapter ring 302 which can be sized to accommodate various size workpieces.

Figure 2:
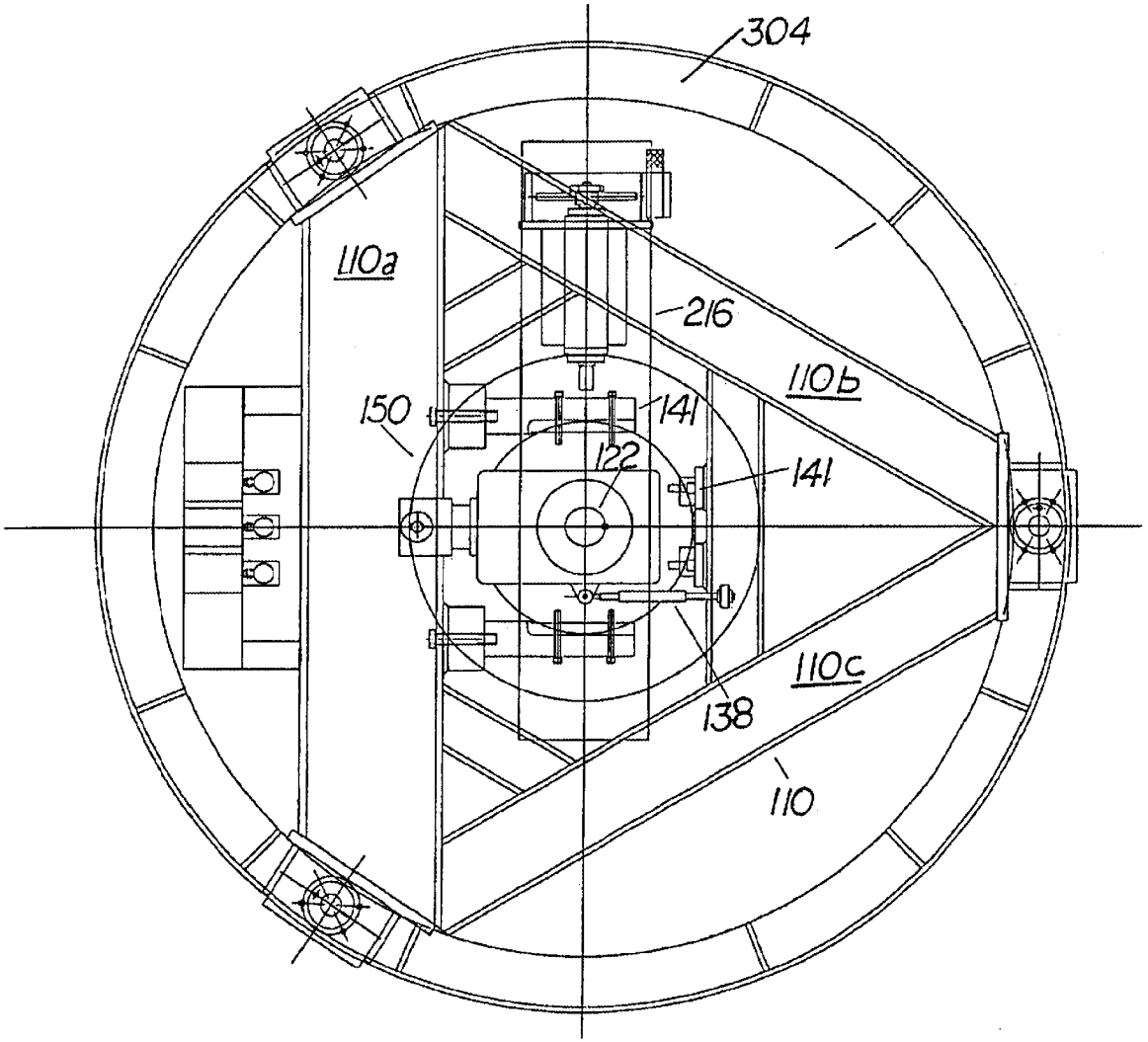
FIG. 2 is a general top plan view of an assembled refinishing apparatus of the invention.

FIG. 2 is a general top plan view of one embodiment of the present invention. The rigid housing 110 is shown, detailing three outward surfaces 110*a*, 110*b* and 110*c*. Adjuster assembly 400 includes an upper assembly 410, a lower assembly 430, and an adjuster screw 440. Each adjuster assembly 400 is secured to the rigid housing 110 of the upper framework 100, and is mounted to the upper flange 304 of the base ring 301 (not shown). Preferably, there are at least three adjuster assemblies secured to the housing 110. As indicated by the solid black lines, the spindle 131 is completely enclosed by the spindle frame 132. The spindle assembly 130 supports rotary union 124, and has a torque arm 138 secured at one side. As also detailed by FIG. 2, the drive shaft 122 is secured to the spindle 131 by bolts 139.

Figure 3B:
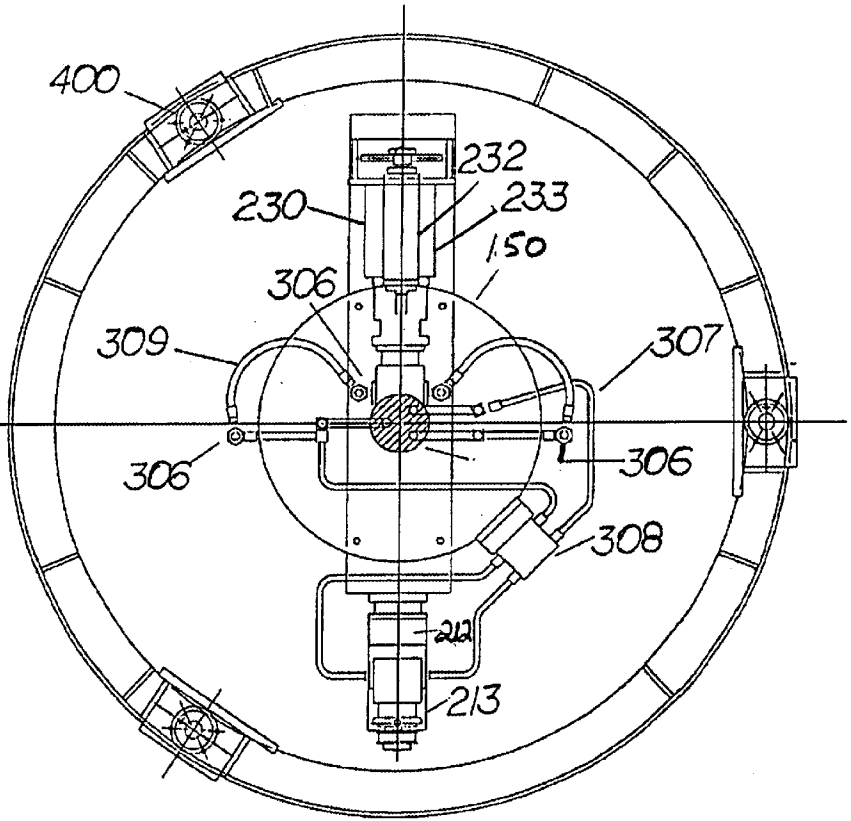
FIG. 3 is a sectional view taken at line A—A of FIG. 1, showing the feed slide in an intermediate position (FIG. 3A) and showing the feed slide in maximum extended position (FIG. 3B).
Figure 3A:
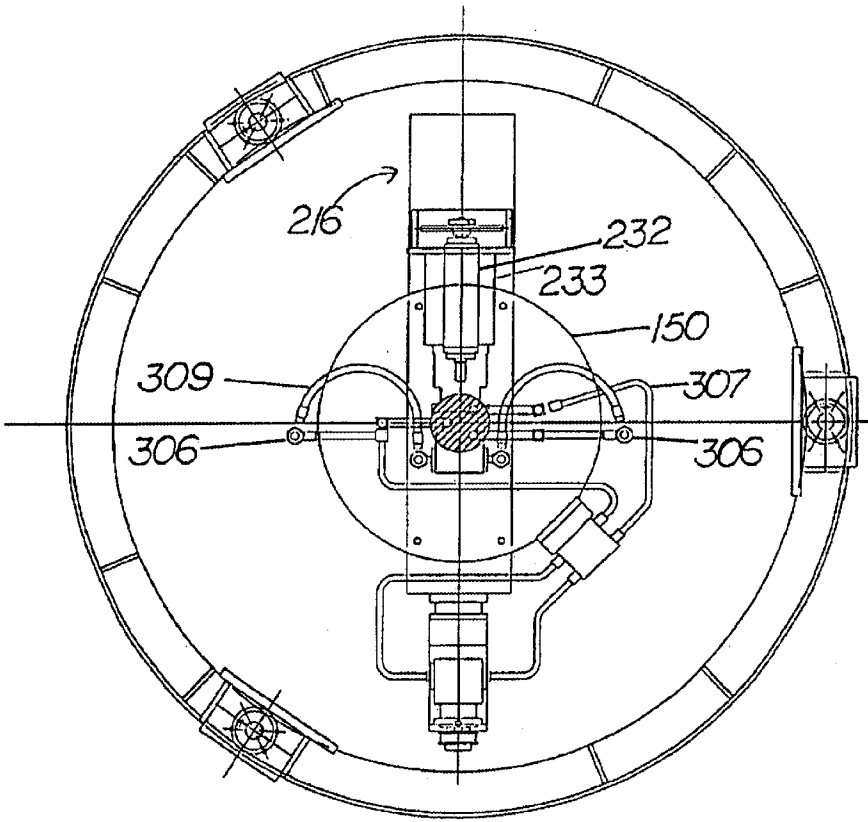

FIG. 3 depicts a sectional view of the spindle assembly 130 and grinding assembly 230, including an optional flexible hose 309 and piping 307 for use when the power source is hydraulic. In FIG. 3A, grinding assembly 230 is shown in an intermediate position; in FIG. 3B, the grinding assembly 230 is shown in an extended position. Although the preferred power source is a hydraulic motor, this equipment can run on just about any power source including, but not limited to, electric or pneumatic motors. Where the power source is hydraulic, a means of providing fluid to major components while they are turning can be incorporated into the apparatus. This is accomplished through the use of rotating unions/joints 306. These four rotary joints 306 are used as shown in FIG. 3 to accommodate the continuous movement of the grinding spindle 232 along the slide arm assembly 216. There are two (2) flexible hoses 309 attached to power the grinder spindle 232 and the feed slide 210. Another flexible hose 309 and a four-way reversing valve feed 308 are attached which is the return to the hydraulic system power supply, using 307 piping as required.

Figure 4:
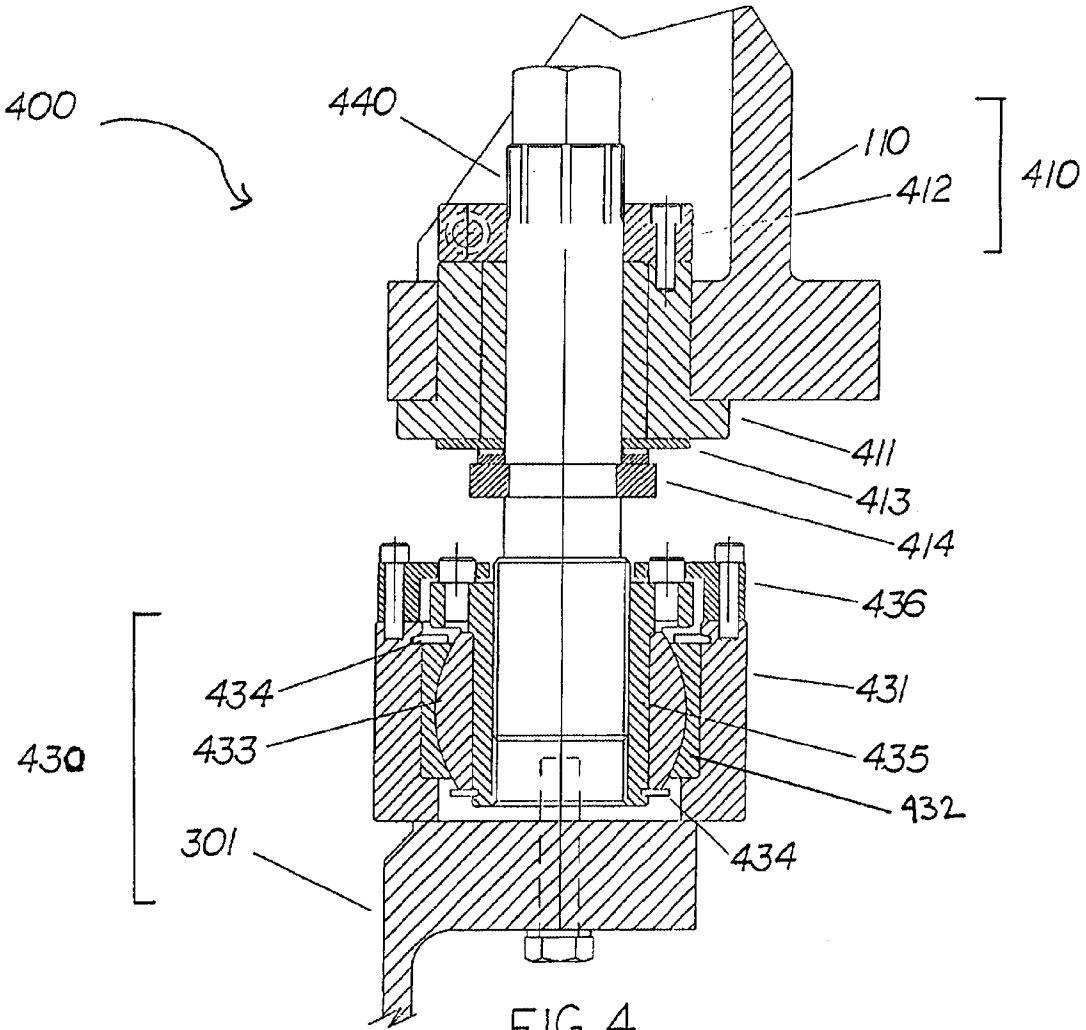
FIG. 4 is a sectional elevation view of an adjuster assembly structure for adjusting the level and height of the grinding wheel.

FIG. 4 illustrates adjuster assembly 400 in greater detail. The adjuster assemblies 400 are devices that allow the rigid housing 110 precise movements in a vertical direction. Three adjuster assemblies are sufficient for adjusting height and achieving balance. It will be appreciated that increasing the number of adjuster assemblies increases the stability and rigidity of the apparatus, but at the expense of making it more difficult and complex to achieve uniform leveling. Each adjuster assembly 400 is fastened to the top surface of the base ring 301 at one of, e.g., three places to support the rigid housing 110. Adjuster assembly 400 allows for vertical adjustment from a fixed base ring 301 (on lower framework 300) to housing 110 (of the upper framework 100). The vertical motion is a precision motion measured in ten thousandths of an inch, depending on the manual rotation of adjuster screw 440.

Adjuster assembly 400 has two sub-assemblies, a top sub-assembly 410 and a bottom sub-assembly 430. The top sub-assembly 410 is mounted on the rigid housing 110 of the upper framework 100. The bottom sub-assembly 430 is mounted on the base ring 301 of the lower framework. The top sub-assembly 410 includes a top sub-assembly housing 411 provided with a plain guide bearing 460 for the adjuster screw 440. A lock collar 412 is provided to prevent rotation of the adjuster screw 440. Thrust bearing assembly 413 and thrust collar 414 bear the load The bottom sub-assembly 430 includes a bottom sub-assembly housing 431 for the spherical bearing assembly 432. The spherical bearing assembly 432 includes a spherical bearing 433, which is captured in bottom sub-assembly housing 431 with snap rings 434, a mating precision internal thread 435, and a torque collar 436 to prevent rotation of the spherical bearing assembly 432. The spherical bearing assembly 432 allows for misalignment between the rigid housing 110 of the upper framework 100 (not fully shown) and the base ring 301 of the lower framework 300 (not fully shown), and prevents binding, or locking up, of the threaded parts, adjuster screw 440 and internal thread 435.

Figure 5A:
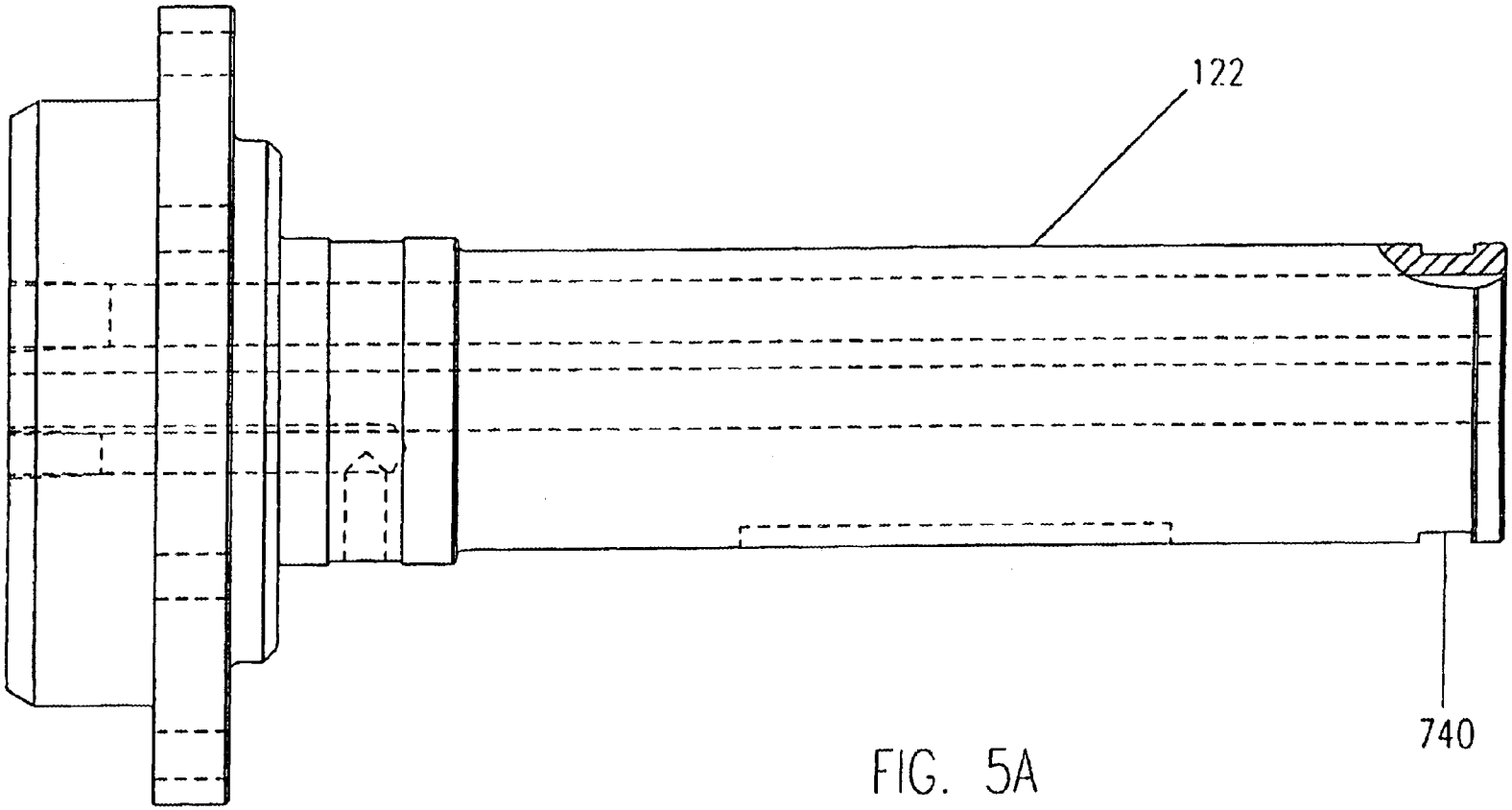
FIG. 5 illustrates a side view of the drive shaft (FIG. 5A), an end view of the bottom end of the drive shaft (FIG. 5B), and an end view of the top end of the drive shaft (FIG. 5C).
Figure 5C:
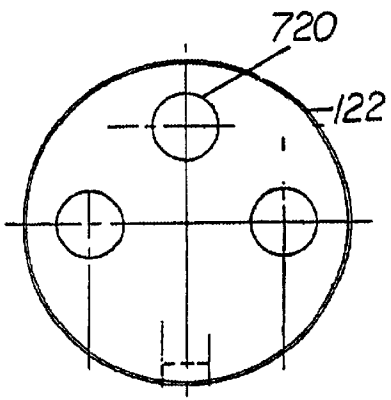
Figure 5B:
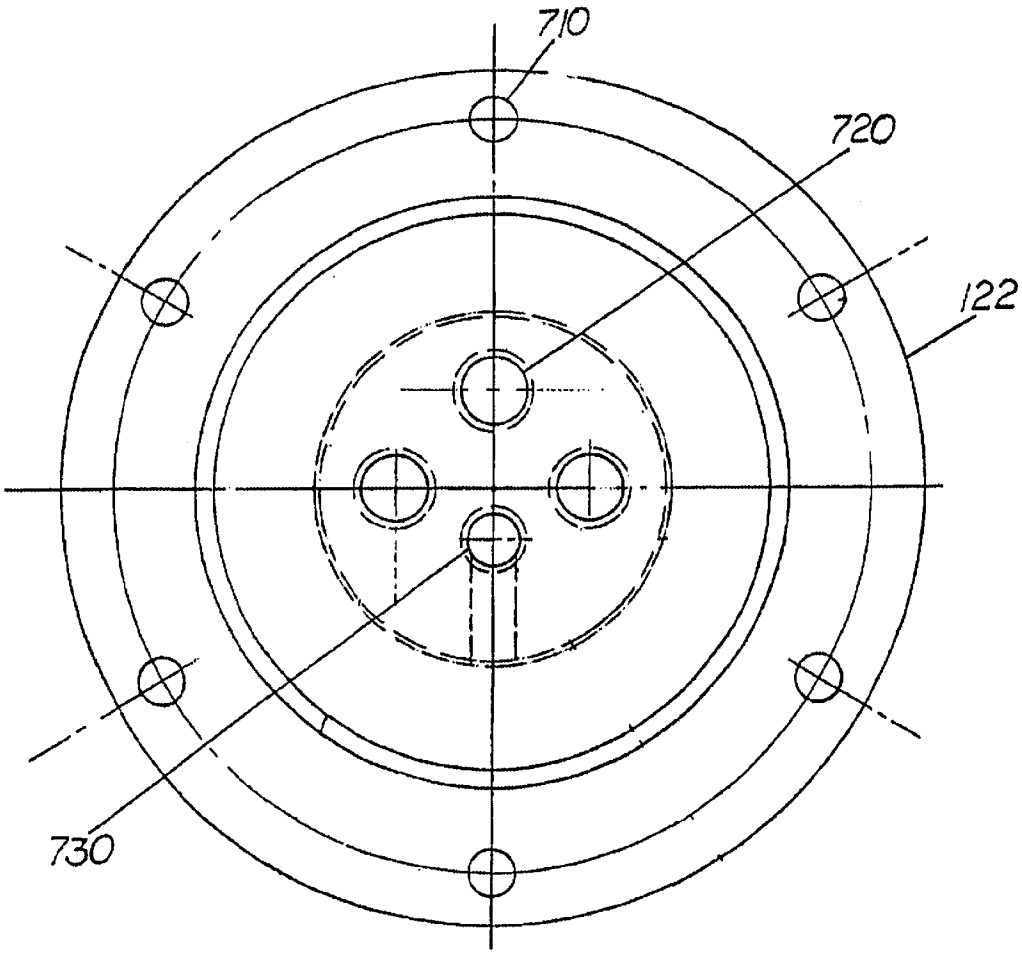

FIG. 5 includes a side view of drive shaft 122 (FIG. 5A), an end view of the bottom end of drive shaft 122 (FIG. 5B), and an end view of the top end of drive shaft 122 (FIG. 5C). Drive shaft 122 is fastened to spindle cover top 136 by fasteners inserted at fastener holes 710. Hydraulic fluid passages 720 extend through drive shaft 122. Optionally, a hole 730 can be included in the bottom end of drive shaft 122. Hole 730 can be used, for example, to apply a coolant or shop air to the workpiece surface 501 (not shown). This optionally can be useful for controlling the cutting quality of the wheel. The groove 740 in the top end of the drive shaft 122 connects to the rotary union (not shown).

The device shown in FIG. 6 relates to a grinding wheel-refinishing process referred to as dressing-truing. During operation, metal shavings and other contaminants become impacted in the grain of the surface of the grinding wheel. Restoring the geometry, or concentricity, of the grinding wheel 235, by eliminating circumferential lobes, restores the cutting properties of the wheel surface. Although the embodiment of a dresser assembly illustrated in FIGS. 6–9 is designed for use when resurfacing the trackplate of a rotary valve, those skilled in the art will appreciate that the invention embodied herein can be applied to any vitreous wheel in need of in-position dressing-truing. The dresser assembly of the invention can be adapted for different sizes and types of vitreous wheels by appropriate design modifications known to those skilled in the art.

Figures 6A, 6B:
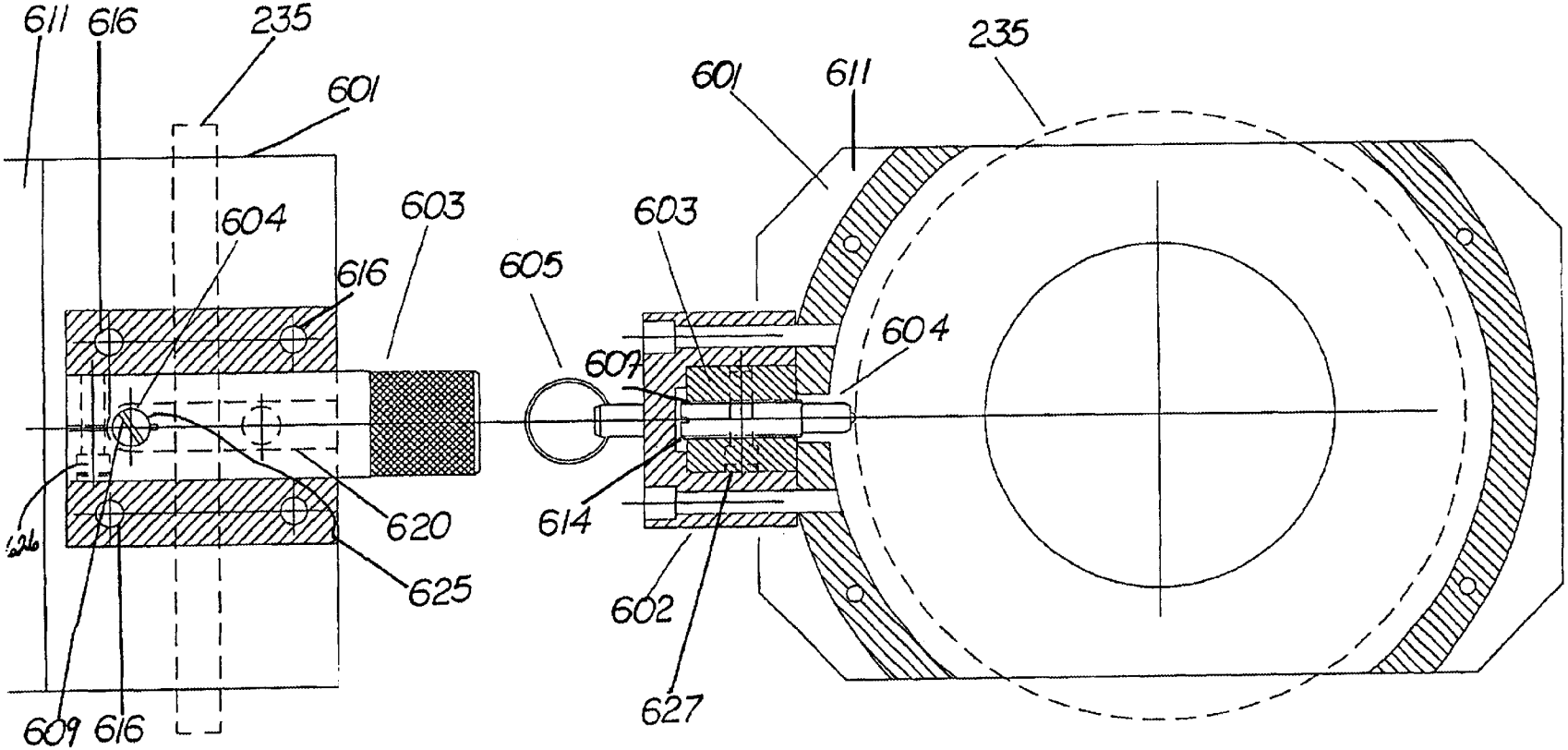
FIG. 6 shows a dresser assembly of the invention in side sectional view (FIG. 6*a*) and in end sectional view (FIG. 6*b*).

In FIG. 6, the dresser assembly 600 includes dresser slide housing 602 and a dresser slide assembly, which in turn includes dresser slide 603 and dresser tool 604. FIG. 6*a* is an inside sectional view, and (FIG. 6*b*) is an end sectional view, of the dresser slide assembly mounted on grinding wheel assembly 230. Grinding wheel 235 is dressed using adjustable dresser tool 604, which is a diamond-tipped tool that is micro-threaded into dresser slide 603. In operation, dresser slide 603 can move laterally across the face of the grinding wheel 235. The micro-thread 607 of the adjustable dresser tool 604 allows adjustment in micro-inches in a radial direction to the center of the wheel. Without limitation, adjustment of the adjustably dresser tool 604 is performed manually. The dresser slide assembly 606, containing the dresser slide 603 and adjustable dresser tool 604, is contained in a compact dresser housing 602, which is in turn mounted on wheel guard 601. Retainer pin 605 locks the dresser assembly 606 in a stored position when not in use. In operation, the dresser slide assembly 603 is manually removed from its stored position and the adjustable dresser 604 is adjusted inward through the medium of its micro-thread 607. The face of the assembly 603 is provided with radial indicator lines 608. Using these marks (lines) and an indicator-screwdriver slot 609 on the adjustable dresser tool 604, adjustments are made as required. The dresser slide assembly 606 is returned to its dresser slide housing 602 and manually moved across the face of the grinding wheel 235. The above procedure can be repeated until the wheel has been restored as desired.

Figure 7:
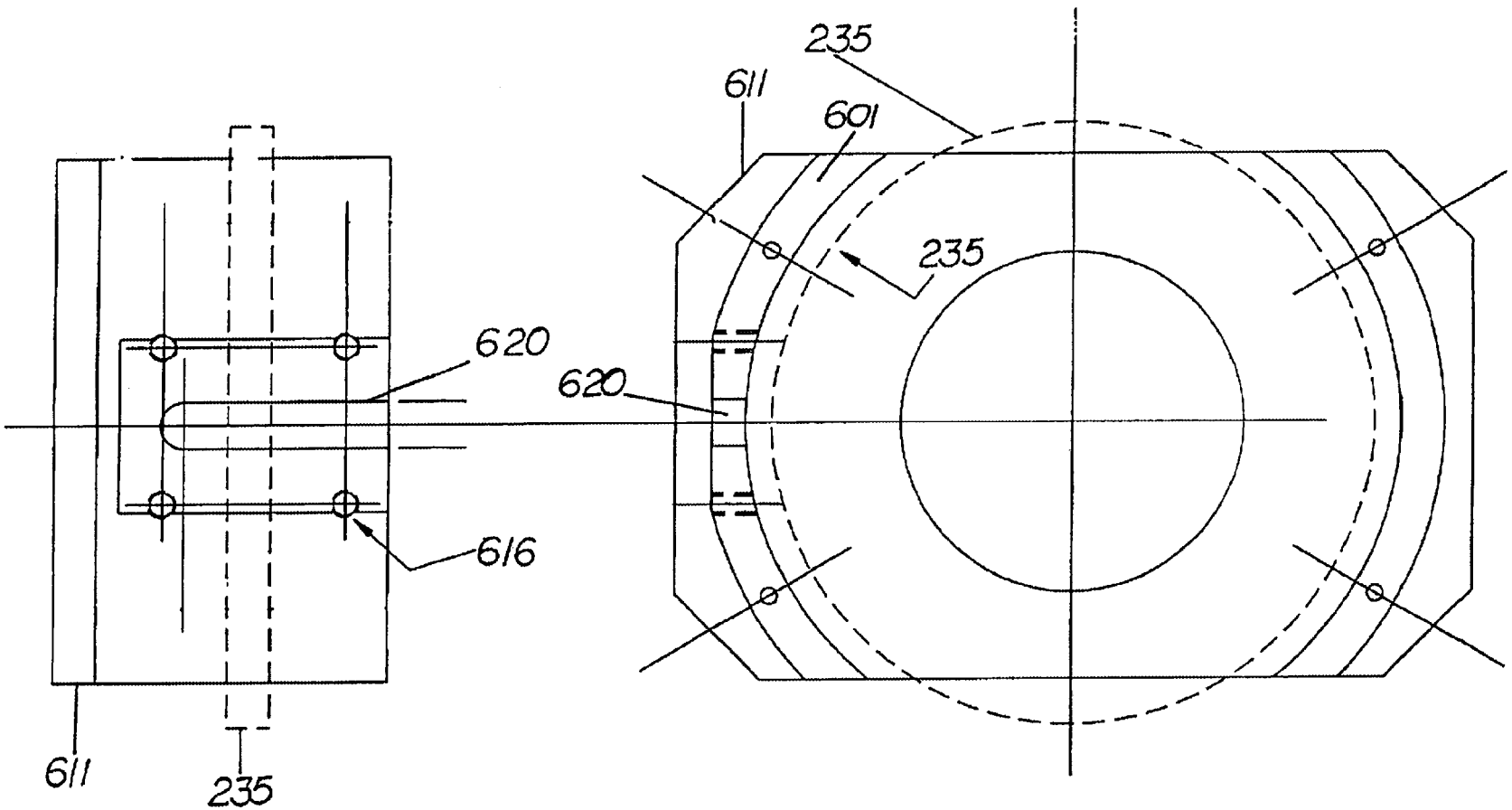
FIG. 7 is an illustration of a grinder wheel guard adapted for use with a dresser assembly in side view (FIG. 7*a*) and in end view (FIG. 7*b*).
Figure 8:
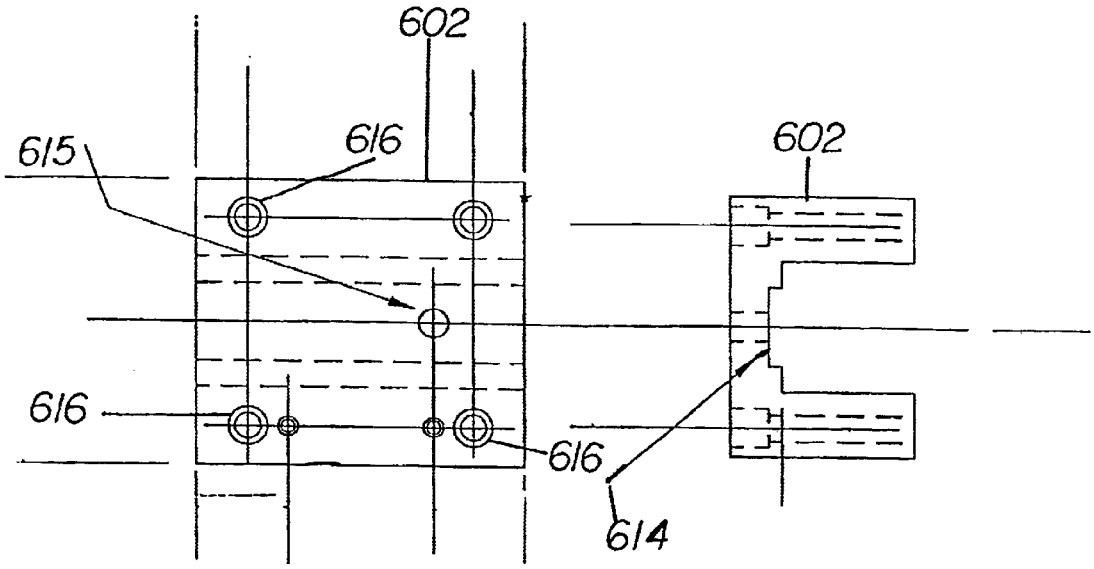
FIG. 8 is a side and end view of a dresser slide housing.
Figure 9:
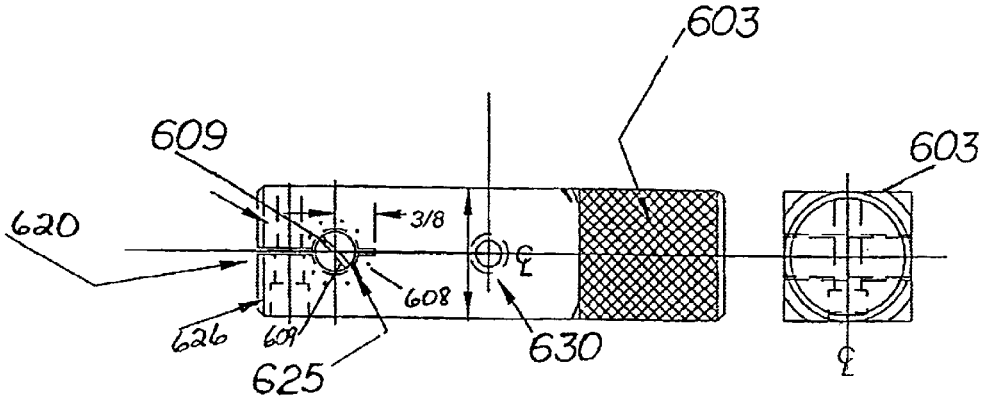
FIG. 9 is a side and end view of a dresser slide with adjustable dresser tool.

The grinder wheel guard can be reworked to accommodate attachment of a dresser assembly, as exemplified by the diagrams shown in FIGS. 7–9. FIG. 7 shows a type of adaptations that can be made to grinder wheel guard 601 for use with a dresser assembly, in side view (FIG. 7*a*) and in end view (FIG. 7*b*). A flat surface is ground onto one side of wheel guard 601 for mounting dresser slide housing 602.

FIGS. 8 and 9 show the manufacture design of an embodiment for dresser slide housing 602 and dresser slide 603. FIG. 8 is a side and end view of a dresser slide housing 602, with mounting screw holes 616 and retainer pinhole 615. Clearance groove 614 is cut in the dresser slide housing 602 for receiving the body of the dresser slide 603. FIG. 9 shows a side view of dresser slide 603, clamp adjusting hole 626 and dresser tool hole 625. When dresser slide 603 is positioned within dresser slide housing 602, slide retainer pin hole 630 lines up with housing retainer pin hole 615. Slot 620 is sawcut into one end of dresser slide 603. In use, adjustable dresser tool 604 can be attached at dresser tool hole 625. Clamp screw 627 is tightened in clamp adjusting hole 626 to prevent excessive motion caused by vibration of the equipment. The dresser slide 603 is prepared from a rectangular metal block, for example, on a lathe, as shown by the end view of dresser slide 603 in FIG. 9.

EXAMPLE 1

The resurfacing apparatus of the invention can be run in conjunction with any power source, including without limitation, an electric motor, a pneumatic motor, or a hydraulic motor. Where the workpiece being machined is in proximity with flammable or volatile substances, as is the case when used to refinish a rotor plate at the site of a petrochemical refinery, it is preferred that the power source be a hydraulic motor, or another power source known to those skilled in the art to have the advantage of producing few, if any, electrical sparks.

EXAMPLE 2

The refinishing apparatus of the invention is used according to the following example. Once the refinishing device is bolted to the workpiece 500, it must be positioned so that it runs concentric with the workpiece 500. This is done by mounting a dial indicator (not shown) on the grinder spindle housing 233 and checking the concentricity with a track wall. If an adjustment is necessary, the base ring 301 must be loosened and moved using a mallet. The base ring 301 is then secured, and the concentricity verified once again.

The machine is then setup parallel to the workpiece 500. This is done by mounting a dial indicator on the grinder spindle housing 233 and checking for parallelism with the workpiece surface 501. If an adjustment is necessary, it is done by turning the adjuster screws 440 as needed (clockwise looking down to lower the machine, counter-clockwise looking down to raise the machine) while the slide arm assembly 216 is slowly rotating about the center of the workpiece 500. The dial indicators mounted at the three-adjuster assemblies 400 are then all "zeroed" out and locked.

With the refinishing device stopped and all power disconnected, a grinding wheel 235 is mounted to the grinder spindle 232 and secured in place with a special washer and nut (not shown) and brought up snug using a spanner wrench. The wheel guard is then mounted and bolted up.

The grinding wheel 235 is positioned just inside the outer diameter of base ring 301 and above the face of the workpiece surface 501 to be ground. With the refinishing device stopped and all power disconnected, the grinding wheel 235 is lowered evenly in small increments, using the three (3) adjuster assemblies 400, until the grinding wheel 235 just touches the surface to be ground. The grinding wheel 235 is positioned just outside the surface to be ground. The slide arm assembly 216 can then begin rotating slowly about the center of the workpiece 500, and speed can be increased as necessary. The grinding wheel 235 can then be fed in towards the center of the workpiece 500. Grinding can be continued until the entire surface has been traversed. The direction can be reversed and the wheel fed back out to the original starting point just outside the surface to be ground. Again, the grinder is lowered evenly to the desired depth of cut and begins feeding the wheel in towards the center of the workpiece 500. Cut depths can be, for example, 0.010 inches, ranging from, without limitation, 0.03 to $0.5\times10^{-3}$ inches to a maximum of 0.1 inches per run. The wheel speed, arm assembly speed, feed rate, and depth of cut can be varied at the discretion of the operator, acceptable settings are known to those skilled in the art. The above procedure is repeated until the required specification for finish and flatness is obtained.

EXAMPLE 3

Optionally, the grinding wheel 235 should need to be dressed in position. For example, the grinder is turned on at a desired speed. With the adjustable dresser tool 604 backed out, insert the dresser slide 603 is inserted into the dresser slide housing 602 until the dresser tool 604 is adjacent the face of the grinding wheel. An estimation of the clearance is made, and the dresser slide 603 is manually removed from the dresser slide housing 602. The dresser tool 604 is turned inward through the medium of its microthread 607 using a spade tip screwdriver. The face of the dresser slide 603 is provided with radial lines adjacent the dresser tool 604. Using these marks (lines) and an indicator-screwdriver slot on the adjustable dresser 604 tool, adjustments are made as required. The dresser slide 603 is returned to the dresser housing 602 and manually moved across the face of the wheel. This procedure is repeated until the wheel has been dressed as desired.

After resurfacing, surface finish and flatness is measured across the entire face of the disk. A profilometer is used to verify the finish against the required workpiece specifications. Flatness requirements can be verified using various methods, such as an electronic level, a laser, an optical flat with a monochromatic light or a precision beam with precision shim stock. In some embodiments, the surface needs to be flat to no greater than a total variance of 0.002 inches and less for workpieces with smaller diameters. The present invention can finish a workpiece to a 16 micro inch finish or better. Specifically, the present invention can refinish workpieces anywhere from 4 inches to 84 inches in diameter. More preferably, the present invention can be used to refinish workpieces that range in diameter from 18 inches to 72 inches.

EXAMPLE 4

Generally, the refinishing device according to the present invention can refinish the surface of any equipment in need thereof. Preferably, the invention is used to refinish a surface through precision machining and grinding, resulting in a flat, precise, and mirror-like surface finish. The present embodiments are therefore to be considered in respects as illustrative and not restrictive, the scope of the invention being indicated by the appended claims rather than by the foregoing description, and all changes which come within the meaning and range of the equivalency of the claims are therefore intended to be embraced therein.

What is claimed is:

1. An apparatus for refinishing a workpiece surface in situ, said apparatus comprising:

a) an upper framework comprising a rotation assembly;

b) a grinding assembly attached in functional rotation to said upper framework and positioned in grinding-functional proximity to a workpiece, wherein said grinding assembly comprises a feed assembly comprising a feed slide and a feed arm coupled to said feed slide, and a grinding wheel assembly coupled to said feed assembly;

c) a lower framework for removable attachment to said workpiece; and d) an adjuster assembly between said upper framework and said lower framework.

2. The refinishing apparatus of claim 1, wherein said upper framework further comprises:

a) a housing;

b) a spindle assembly connected to said housing and in functional connection with said rotation assembly; and c) a drive mounting plate between said spindle assembly and said grinding assembly.

3. The refinishing apparatus of claim 2, wherein said rotation assembly comprises:

a) a drive motor;

b) a drive shaft;

c) a hollow shaft reducer coupled to said drive shaft; and d) a rotary union connected to said drive shaft.

4. The refinishing apparatus of claim 3, wherein a passage extends axially through said housing and said drive shaft extends axially through said passage.

5. The refinishing apparatus of claim 4, wherein said workpiece has a central axis, and said rotary union causes said drive shaft to rotate said grinding assembly about said central axis of said workpiece.

6. The refinishing apparatus of claim 2, where said spindle assembly comprises:

a) a spindle;

b) a spindle frame, attached to said spindle;

c) a plurality of spindle bearings, said bearings disposed between said spindle and said spindle frame;

d) a spacer disposed between said spindle and said spindle frame; and e) a top and bottom spindle cover, wherein said covers are securely attached to said spindle and said spindle frame.

7. The refinishing apparatus of claim 1, wherein said grinding wheel assembly comprises:

a) a wheel drive motor assembly;

b) a grinder spindle connected to said wheel drive motor assembly; and c) a grinding wheel rotably coupled to said grinder spindle.

8. The refinishing apparatus of claim 1, wherein said lower framework comprises:

a) a base ring; and b) an adapter ring removably attached to said base ring.

9. The refinishing apparatus of claim 8, wherein said adapter ring is removably secured to said workpiece.

10. The refinishing apparatus of claim 1, wherein said adjuster assembly system comprises:

a) upper assembly;

b) a lower assembly;

c) an adjuster screw, said adjuster screw connecting said upper assembly to said lower assembly.

11. The refinishing apparatus of claim 10, wherein said upper assembly is connected to said upper framework and said lower assembly is connected to said lower framework.

12. The refinishing apparatus of claim 1, wherein said grinding wheel assembly further comprises a wheel guard mounted on said grinder spindle.

13. The refinishing apparatus of claim 12, wherein said grinding wheel assembly is in functional proximity to a dresser assembly comprising a dresser tool.

14. The refinishing apparatus of claim 1, further comprising a power source attaching assembly.

15. The refinishing apparatus of claim 14, wherein said power source attaching assembly is a hydraulic motor attaching assembly.

16. The refinishing apparatus of claim 1, further comprising a dresser assembly for in-position restoration of a grinding wheel, said dresser assembly comprising:

a) a dresser slide housing;

b) a dresser slide movably disposed within said dresser slide housing;

c) a dresser tool attached to said dresser slide; and d) means for placing said dresser slide housing in functional proximity to a grinder wheel for in-position dressing of said grinding wheel.

17. A method of refinishing a workpiece surface, comprising the steps of:

a) attaching the refinishing apparatus of claim 16 to a workpiece;

b) allowing said grinding assembly to rotate while refinishing said workpiece while said grinding assembly, wherein said grinding assembly including a grinding wheel; and c) allowing said dresser assembly to dress said grinding wheel in-position in said grinding assembly.

18. An apparatus for refinishing a workpiece surface in situ, said apparatus comprising:

a) an upper framework comprising a rotation assembly:

b) a grinding assembly attached in functional rotation to said upper framework and positioned in grinding-functional proximity to a workpiece;

c) a lower framework for removable attachment to said workpiece; and d) an adjuster assembly between said upper framework and said lower framework, wherein said upper assembly comprises:

i) a lock collar attached to said adjuster screw;

ii) a screw bushing assembly attached to said lock collar;

iii) a thrust bearing assembly, attached to said screw bushing assembly; and iv) a thrust collar attached to said thrust-bearing assembly.

19. An apparatus for refinishing a workpiece surface in situ, said apparatus comprising:

a) an upper framework comprising a rotation assembly;

b) a grinding assembly attached in functional rotation to said upper framework and positioned in grinding-functional proximity to a workpiece;

c) a lower framework for removable attachment to said workpiece; and d) an adjuster assembly between said upper framework and said lower framework, wherein said lower assembly comprises:

i) torque collar attached to said adjuster screw;

ii) at least one base adjuster screw attached to said torque collar;

iii) at least one spherical bushing attached to said base adjuster screw;

iv) at least one retainer ring attached to said spherical bushing;

v) at least one spherical bearing adapter disposed between said torque collar and said spherical bushing; and vi) at least one retaining ring attached to said spherical bushing adapter.

20. An apparatus for refinishing a workpiece surface in situ, said apparatus comprising:

a) an upper framework comprising a rotation assembly;

b) a grinding assembly attached in functional rotation to said upper framework and positioned in grinding-functional proximity to a workpiece;

c) a lower framework for removable attachment to said workpiece;

d) an adjuster assembly between said upper framework and said lower framework; and e) a power source attaching assembly, wherein said power source attaching assembly comprises a rotary union.

* * * * *